US011607003B2

(12) United States Patent
Liu

(10) Patent No.: US 11,607,003 B2
(45) Date of Patent: Mar. 21, 2023

(54) SHOE WITH BUBBLE CREATION DEVICE

(71) Applicant: Tai Sheng Liu, Taichung (TW)

(72) Inventor: Tai Sheng Liu, Taichung (TW)

( * ) Notice: Subject to any disclaimer, the term of this patent is extended or adjusted under 35 U.S.C. 154(b) by 232 days.

(21) Appl. No.: 17/081,073

(22) Filed: Oct. 27, 2020

(65) Prior Publication Data

US 2021/0169169 A1 Jun. 10, 2021

(30) Foreign Application Priority Data

Dec. 10, 2019 (TW) ..... 108216366

(51) Int. Cl.

| | |
|---|---|
| ***A43B 3/36*** | (2022.01) |
| ***A63H 29/22*** | (2006.01) |
| ***A63H 33/28*** | (2006.01) |
| ***A43B 3/50*** | (2022.01) |

(52) U.S. Cl.

CPC ..... *A43B 3/36* (2022.01); *A43B 3/50* (2022.01); *A63H 29/22* (2013.01); *A63H 33/28* (2013.01)

(58) Field of Classification Search

CPC ..... A63H 29/22; A63H 33/28; A43B 3/36; A43B 3/50

USPC ..... 446/15

See application file for complete search history.

(56) References Cited

U.S. PATENT DOCUMENTS 3,228,136 A * 1/1966 Rouse ..... A63H 33/28 446/16
4,020,572 A * 5/1977 Chiaramonte, Jr. . A43B 1/0072 36/137
4,423,565 A * 1/1984 Bart ..... A63H 33/28 446/16
5,498,191 A * 3/1996 DeMars ..... A63H 33/28 446/178
5,564,201 A * 10/1996 O'Connell ..... A43B 3/00 36/3 R
5,765,300 A * 6/1998 Kianka ..... A43B 3/50 36/8.3
6,921,312 B2 * 7/2005 Thai ..... A63H 33/28 446/176
7,059,930 B2 * 6/2006 Choi ..... A63H 33/28 446/178
7,213,354 B1 * 5/2007 Byrd ..... A43B 7/144 36/25 R
8,141,889 B2 * 3/2012 Yu ..... B62K 3/002 280/87.041
8,267,736 B2 * 9/2012 Lam ..... A63H 33/28 446/19
8,888,549 B2 * 11/2014 Lo ..... A63H 33/28 446/16
10,668,399 B2 * 6/2020 Weigl, Jr. ..... A63H 33/28
(Continued)

*Primary Examiner* — Joseph B Baldori

(57) ABSTRACT

A bubble creation device is disposed in a sole of a shoe and include a soapy water container for storing soapy water, a bubble blowing module, and at least one tube having two ends connected to the soapy water container and the bubble blowing module respectively and being in fluid communication therewith. The bubble blowing module includes a channel in a housing and having an outlet open to the atmosphere, and an air inlet open to the atmosphere; a blowing unit in the housing for flowing air from the channel to the outlet; a film forming unit through the outlet and communicating with the at least one tube; a power unit in the housing for supplying power to the blowing unit; and an on/off switch on the sole for controlling an activation of the blowing unit.

6 Claims, 5 Drawing Sheets

(56) References Cited

U.S. PATENT DOCUMENTS

| | | | | |
|---|---|---|---|---|
| 2007/0037467 | A1* | 2/2007 | Thai | A63H 33/28<br>446/15 |
| 2007/0164521 | A1* | 7/2007 | Robinson | A43B 5/16<br>280/11.19 |
| 2008/0110061 | A1* | 5/2008 | Ritter | A43B 13/14<br>36/25 R |
| 2012/0208426 | A1* | 8/2012 | Kuo | A63H 33/28<br>446/15 |
| 2014/0047738 | A1* | 2/2014 | Prats | A43B 23/24<br>36/103 |
| 2014/0141688 | A1* | 5/2014 | Kelly | A63H 33/28<br>446/15 |
| 2018/0345164 | A1* | 12/2018 | Venigalla | A63H 33/28 |
| 2019/0213850 | A1* | 7/2019 | Liu | A43B 7/06 |

* cited by examiner

SHOE WITH BUBBLE CREATION DEVICE

BACKGROUND OF THE INVENTION

1. Field of the Invention

The invention relates to shoes and more particularly to a shoe having a bubble creation device for recreation and providing entertainment.

2. Description of Related Art

Conventionally, a shoe is an item of footwear intended to protect and comfort the human foot. Further, shoes have aesthetic effects. However, no entertainment is provided by conventional shoes as far as the present inventor is aware.

Thus, the need for improvement still exists.

SUMMARY OF THE INVENTION

It is therefore one object of the invention to provide a shoe having a bubble creation device with characteristics including a simple structure, an easy operation, bubble creation capability, recreation and providing entertainment.

For achieving above and other objects, the invention provides a shoe comprising a sole; and a bubble creation device disposed in the sole and including a soapy water container for storing soapy water, a bubble blowing module, and at least one tube having two ends connected to the soapy water container and the bubble blowing module respectively and being in fluid communication therewith; wherein the bubble blowing module includes a housing; a channel disposed in the housing and having an outlet open to the atmosphere, and an air inlet open to the atmosphere; a blowing unit disposed in the housing and configured to flow air from the channel to the outlet; a film forming unit disposed through the outlet and communicating with the at least one tube; a power unit disposed in the housing and configured to supply power to the blowing unit; and an on/off switch disposed on the sole and electrically connected to both the blowing unit and the power unit, the on/off switch being configured to control an activation of the blowing unit.

Preferably, the housing includes an upper shell and a lower shell complimentarily secured to the upper shell.

Preferably, the blowing unit includes a plurality of blades disposed in the channel, and an electric motor for rotating the blades to create a flow of air toward the outlet.

Preferably, the film forming unit includes an inner member disposed through the outlet and including a film forming aperture, an annular flange outwardly projecting out of the film forming aperture, an annular groove formed between the annular flange and an inner surface of the inner member, and at least one water outlet through the annular groove to communicate with the at least one tube so that the soapy water in the soapy water container is configured to flow to the annular groove; an outer member disposed through the outlet to sleeve on the inner member and including a bubble outlet having a bore smaller than that of the film forming aperture and passing through the film forming aperture; a rotational member engaged with the annular flange and including an inward extending shaft coaxial with the annular flange so that the rotational member is configured to apply the soapy water to the annular flange to form a film to block the film forming aperture; and a gear train disposed in the housing and including a plurality of gears meshed together; wherein the shaft is secured to one of the gears so that torque generated by the electric motor is configured to transmit to the rotational member via the gear train and the shaft, thereby rotating the rotational member at a reduced speed.

Preferably, the bubble creation device further comprises at least one light emitting unit wherein in response to turning on the on/off switch, the at least one light emitting unit is configured to emit light.

Preferably, the bubble creation device further comprises a loudspeaker wherein in response to turning on the on/off switch, the loudspeaker is configured to make a sound.

Preferably, the power unit includes a rechargeable battery and a charging socket so that wall power is configured to supply to the rechargeable battery for storage via the charging socket and the rechargeable battery is configured to drive the electric motor.

Preferably, the charging socket is a Universal Serial Bus (USB) port.

The invention has the following advantages and benefits in comparison with the conventional art: the bubble creation device can continuously create and blow bubbles so that a wearer of the shoes of the invention and surrounding people may chase the bubbles for recreation and providing entertainment. Alternatively, a wearer of the shoes of the invention may show in a dinner party, a stage or a dancing party to amuse people.

The bubble blowing module includes the housing, the blowing unit, the film forming unit, the power unit and the on/off switch. The channel is provided in the housing and includes the outlet open to the atmosphere, and the air inlet open the atmosphere. The bubble blowing module is in the housing and can blow air out of the shoe to draw a predetermined amount of soapy water from the soapy water container to the film forming unit via the at least one tube using Bernoulli's principle. The film forming unit can generate a film in a predetermined period of time using the soapy water and the film is used to create bubbles to be blown out of the shoe. The power unit is disposed in the housing and configured to supply power to the blowing unit. The on/off switch is provided on the shoe and electrically connected to both the blowing unit and the power unit. The on/off switch can control an activation of the blowing unit.

The above and other objects, features and advantages of the invention will become apparent from the following detailed description taken with the accompanying drawings.

DETAILED DESCRIPTION OF THE INVENTION

Figure 1:
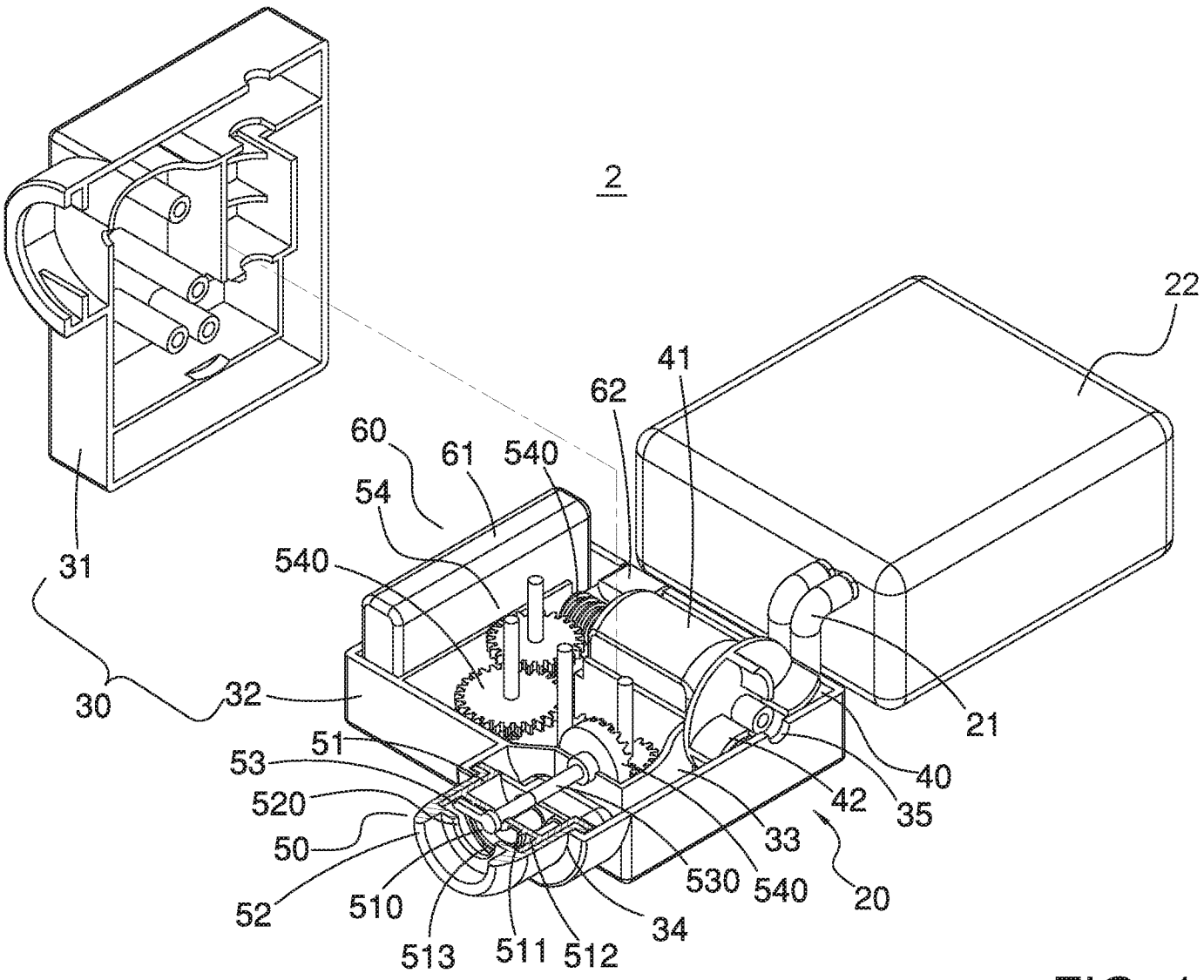
FIG. 1 is an exploded perspective view of a bubble creation device according to the invention.
Figure 2:
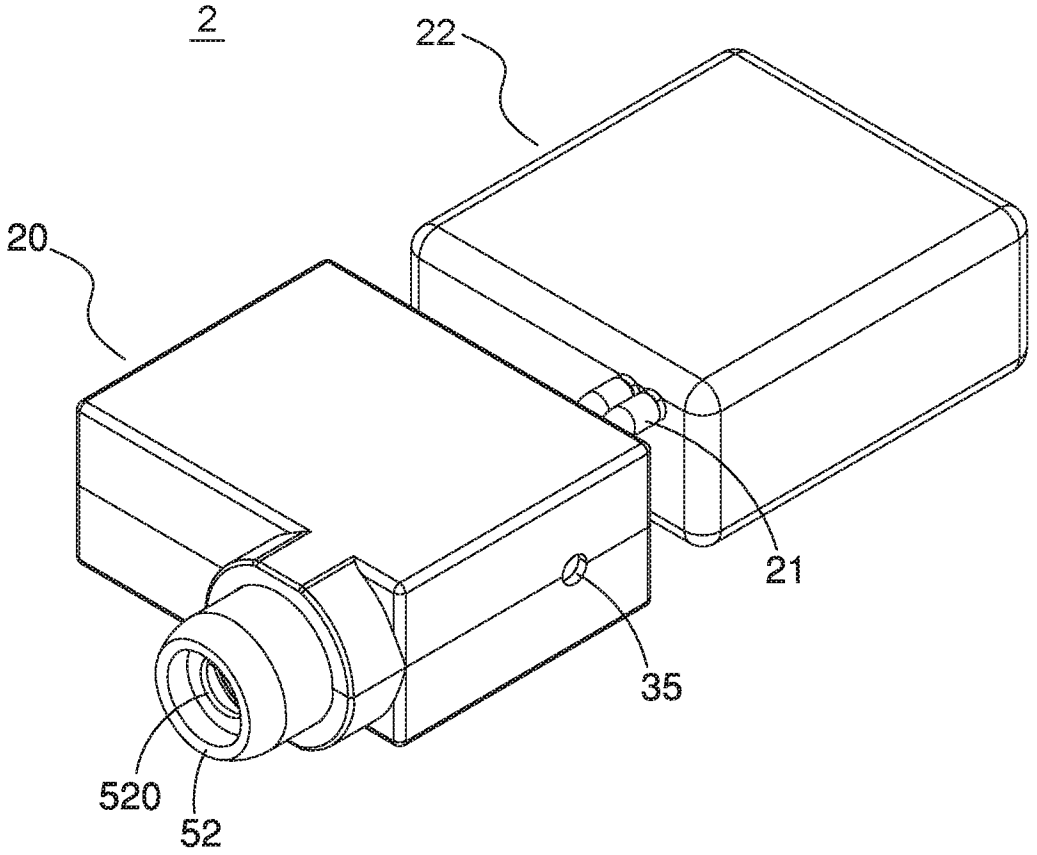
FIG. 2 is a perspective view of the assembled bubble creation device.
Figure 3:
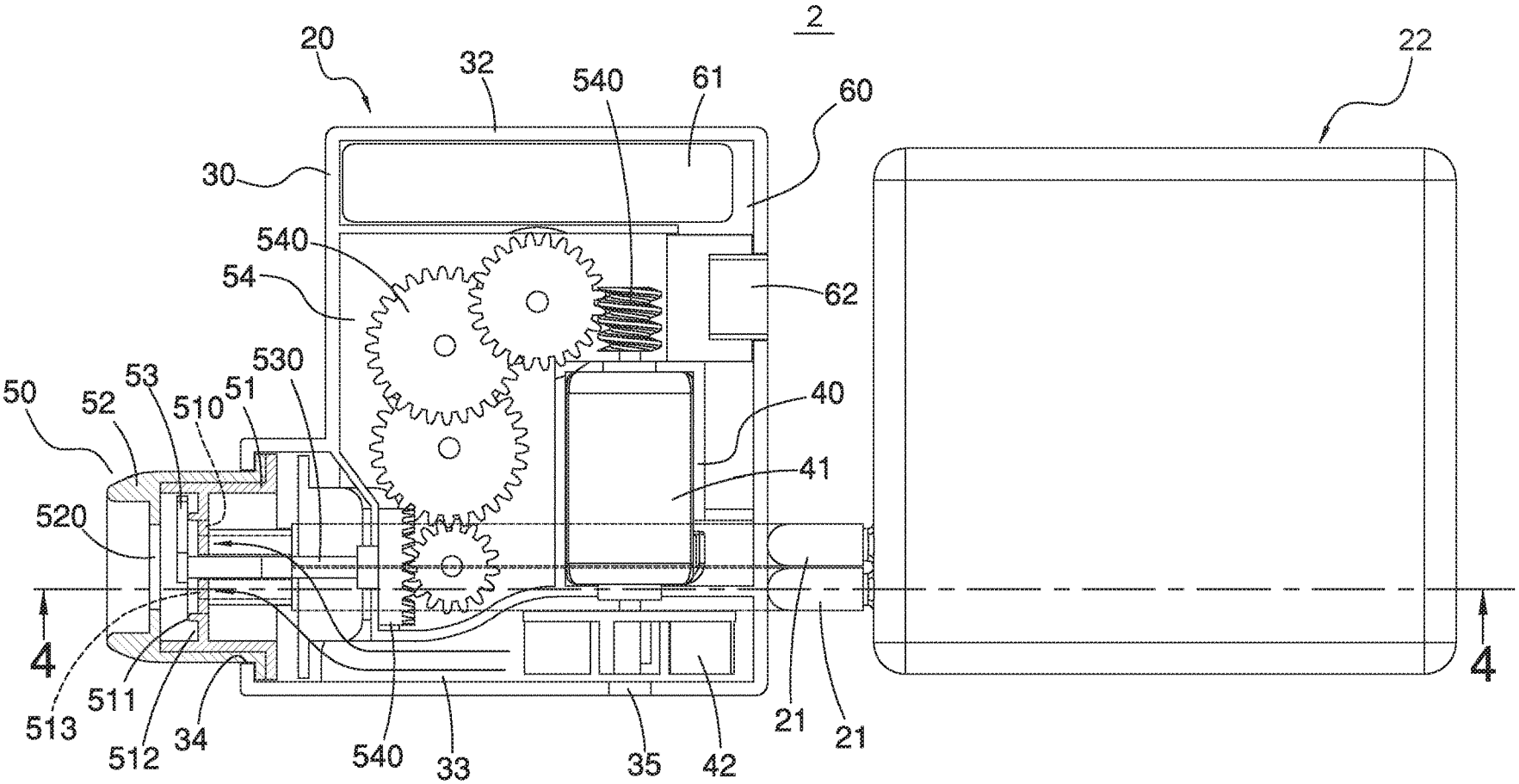
FIG. 3 is a cross-sectional view of FIG. 2.
Figure 4:
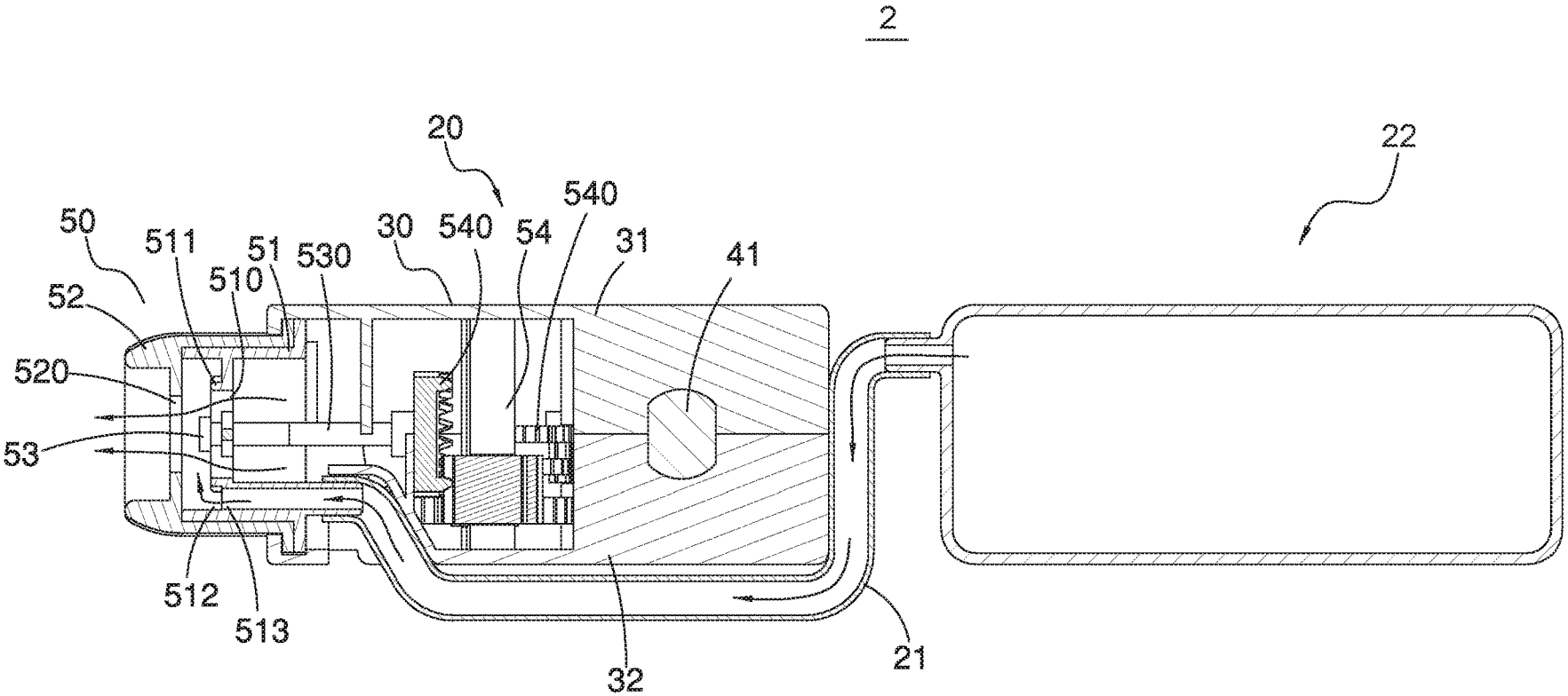
FIG. 4 is a longitudinal sectional view taken along line 4-4 of FIG. 3.
Figure 5:
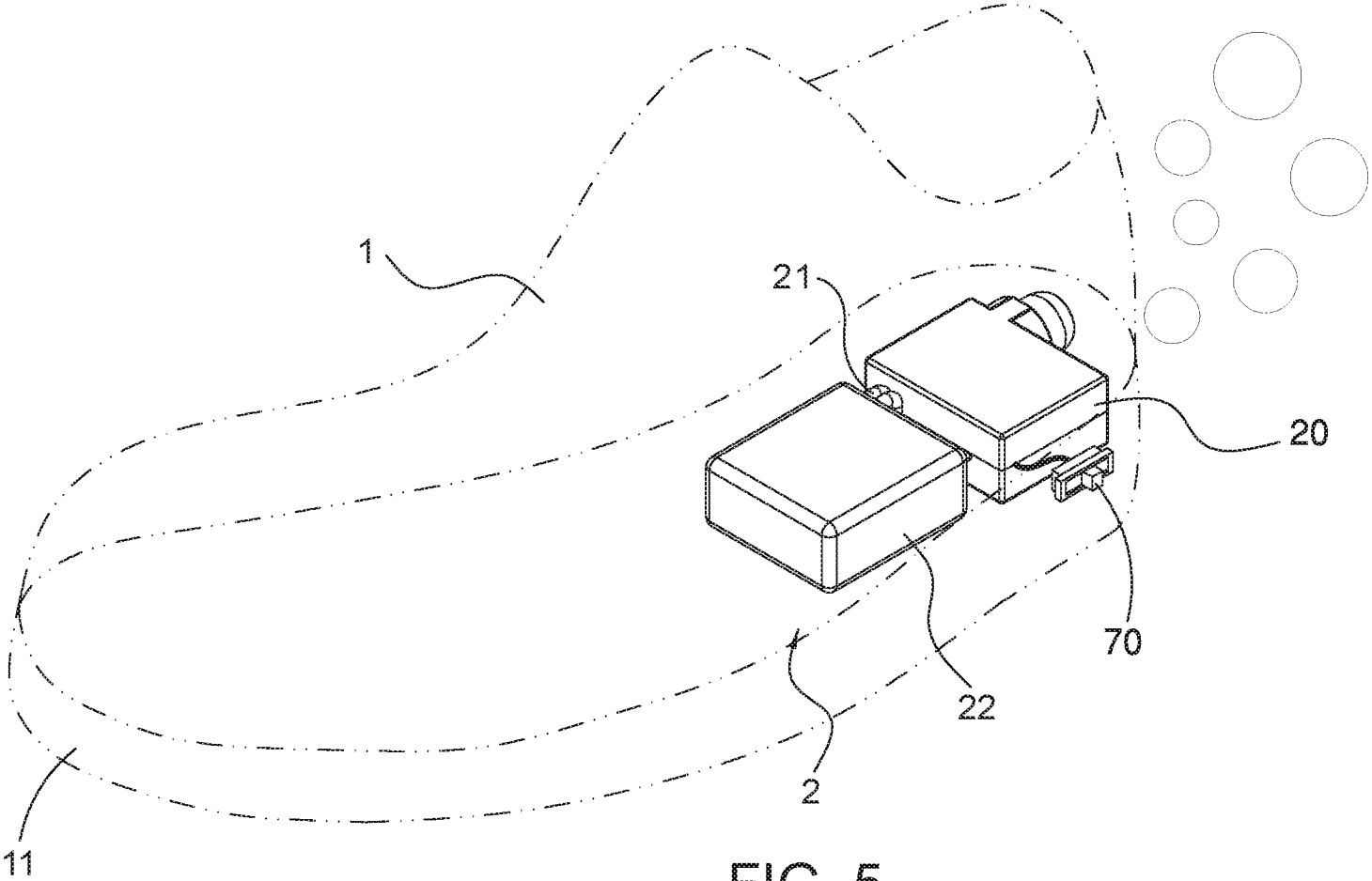
FIG. 5 schematically shows the bubble creation device mounted in a shoe.

Referring to FIGS. 1 to 5, the invention comprises a shoe 1 and a bubble creation device 2 as discussed in detail below.

The shoe 1 includes a sole 11. The bubble creation device 2 is disposed in the sole 11 and includes a soapy water container 22 for storing soapy water, a bubble blowing module 20, and at least one tube 21 having two ends connected to the soapy water container 22 and the bubble blowing module 20 respectively and being in fluid communication therewith. The bubble blowing module 20 can blow air out of the shoe 1 to draw a predetermined amount of soapy water from the soapy water container 22 via the at least one tube 21 using Bernoulli's principle and can generate a film in a predetermined period of time soapy water and the film is used to create bubbles to be blown out of the shoe 1.

The bubble blowing module 20 includes a housing 30, a blowing unit 40, a film forming unit 50, a power unit 60 and an on/off switch 70. The housing 30 includes an upper shell 31 and a lower shell 32 complimentarily secured together. A channel 33 is provided in the housing 30 and includes an outlet 34 open to the atmosphere, and an air inlet 35 open to the atmosphere.

The blowing unit 40 is disposed in the housing 30 and includes a plurality of blades 42 disposed in the channel 33 and an electric motor 41 for rotating the blades 42 to create a flow of air toward the outlet 34.

The film forming unit 50 includes an inner member 51, an outer member 52, a rotational member 53 and a gear train 54. The inner member 51 is disposed through the outlet 34 and includes a film forming aperture 510, an annular flange 511 outwardly projecting out of the film forming aperture 510, an annular groove 512 formed between the annular flange 511 and an inner surface of the inner member 51, and at least one water outlet 513 through the annular groove 512 to communicate with the at least one tube 21. The outer member 52 is disposed through the outlet 34 to sleeve on the inner member 51 and includes a bubble outlet 520 having a bore smaller than that of the film forming aperture 510 and passing through the film forming aperture 510. The rotational member 53 is engaged with the annular flange 511 and includes an inward extending shaft 530 coaxial with the annular flange 511. The gear train 54 includes a plurality of gears 540 meshed together. The shaft 530 is secured to one of the gears 540 so that torque generated by the electric motor 41 can be transmitted to the rotational member 53 via the gear train 54 and the shaft 530. As a result, the rotational member 53 rotates at a reduced speed.

The power unit 60 is disposed in the housing 30 and includes a rechargeable battery 61 and a charging socket 62. Wall power can be supplied to the rechargeable battery 61 for storage via the charging socket 62 and thus the rechargeable battery 61 can drive the electric motor 41. The charging socket 62 is a Universal Serial Bus (USB) port.

The on/off switch 70 is disposed on one side of the sole 11 and electrically connected to the conducting path in an electrical circuit including the rechargeable battery 61 for controlling the activation or deactivation of the electric motor 41.

In use, in response to turning on the on/off switch 70, the electric motor 41 activates. And in turn, both the blades 42 rotate and the gear train 54 rotates. The rotating blades 42 create a flow of air to draw soapy water out of the soapy water container 22 using Bernoulli's principle. The flow of air flows from the channel 33, the film forming aperture 510, to the bubble outlet 520 and into the atmosphere. The soapy water flows from the at least one tube 21, and the water outlet 513 to the annular groove 512. At the same time, the gear train 54 rotates the shaft 530 in a reduced speed. Further, the rotational member 53 applies the soapy water to the annular flange 511 to form a film to block the film forming aperture 510. Also, the flow of air blows to the film to form bubbles to the atmosphere via the bubble outlet 520. After the film has been blown, another film is formed when the rotational member 53 continues to apply the soapy water to the annular flange 511. As a result, bubbles are continuously blown.

Additionally, at least one light emitting unit and a loudspeaker (both not shown) are provided in the bubble creation device 2. In response to turning on the on/off switch 70, the at least one light emitting unit may emit light and the loudspeaker may make a sound. It is envisaged by the invention that the bubble creation device 2 can continuously create and blow bubbles so that a wearer of the shoes 1 of the invention and surrounding people may chase the bubbles for recreation and provide entertainment.

While the invention has been described in terms of preferred embodiments, those skilled in the art will recognize that the invention can be practiced with modifications within the spirit and scope of the appended claims.

What is claimed is:

1. A shoe comprising:

a sole; and a bubble creation device disposed in the sole and including a soapy water container for storing soapy water, a bubble blowing module, and at least one tube having two ends connected to the soapy water container and the bubble blowing module respectively and being in fluid communication therewith;

wherein the bubble blowing module includes a housing; a channel disposed in the housing and having an outlet open to the atmosphere, and an air inlet open to the atmosphere; a blowing unit disposed in the housing and configured to flow air from the channel to the outlet; a film forming unit disposed through the outlet and communicating with the at least one tube; a power unit disposed in the housing and configured to supply power to the blowing unit; and an on/off switch disposed on the sole and electrically connected to both the blowing unit and the power unit, the on/off switch being configured to control an activation of the blowing unit, wherein the blowing unit includes a plurality of blades disposed in the channel, and an electric motor for rotating the blades to create a flow of air toward the outlet, and wherein the film forming unit includes:

an inner member disposed through the outlet and including a film forming aperture, an annular flange outwardly projecting out of the film forming aperture, an annular groove formed between the annular flange and an inner surface of the inner member, and at least one water outlet through the annular groove to communicate with the at least one tube so that the soapy water in the soapy water container is configured to flow to the annular groove;

an outer member disposed through the outlet to sleeve on the inner member and including a bubble outlet having a bore smaller than that of the film forming aperture and passing through the film forming aperture;

a rotational member engaged with the annular flange and including an inward extending shaft coaxial with the annular flange so that the rotational member is configured to apply the soapy water to the annular flange to form a film to block the film forming aperture; and a gear train disposed in the housing and including a plurality of gears meshed together, wherein the shaft is secured to one of the gears so that torque generated by the electric motor is configured to transmit to the rotational member via the gear train and the shaft, thereby rotating the rotational member at a reduced speed.

2. The shoe of claim 1, wherein the housing includes an upper shell and a lower shell complimentarily secured to the upper shell.

3. The shoe of claim 1, wherein the bubble creation device further comprises at least one light emitting unit wherein in response to turning on the on/off switch, the at least one light emitting unit is configured to emit light.

4. The shoe of claim 1, wherein the bubble creation device further comprises a loudspeaker wherein in response to turning on the on/off switch, the loudspeaker is configured to make a sound.

5. The shoe of claim 1, wherein the power unit includes a rechargeable battery and a charging socket so that wall power is configured to supply to the rechargeable battery for storage via the charging socket and the rechargeable battery is configured to drive the electric motor.

6. The shoe of claim 5, wherein the charging socket is a Universal Serial Bus (USB) port.

* * * * *